United States Patent [19]

Libert

[11] Patent Number: 4,644,253

[45] Date of Patent: Feb. 17, 1987

[54] VOLTAGE REFERENCE SOURCE WITH TRUE GROUND SENSING AND FORCE-SENSE OUTPUTS REFERRED THERETO

[75] Inventor: Robert J. Libert, Rowley, Mass.

[73] Assignee: Analog Devices, Inc., Norwood, Mass.

[21] Appl. No.: 829,432

[22] Filed: Feb. 13, 1986

[51] Int. Cl.[4] ..... G05F 1/10

[52] U.S. Cl. ..... 323/275; 323/349

[58] Field of Search ..... 323/274, 275, 349, 350, 323/351; 324/51

[56] References Cited

U.S. PATENT DOCUMENTS 4,295,089 10/1981 Cooperman ..... 323/351

*Primary Examiner*—Peter S. Wong
*Assistant Examiner*—Judson H. Jones
*Attorney, Agent, or Firm*—Wolf, Greenfield & Sacks

[57] ABSTRACT

A voltage reference source for supplying one or more reference voltages to load circuitry. The reference source comprises an ungrounded voltage reference cell (20) floated between two power supply levels (Vcc and Vee), and an operational amplifier (22) whose non-inverting input (terminal 9) may be connected to sense the voltage of the load circuit's ground node. The inverting input of the op amp (terminal 10) may be connected to various nodes (6, 8, 11) in the reference cell; the voltage on the selected node is forced to match the sensed ground voltage and that node thus becomes an internal ground reference point. The high input impedance of the op amp (22) limits the current in the ground sensing path to a very low value, such as about 10 nA. Consequently, very little voltage is developed in the leads from the load circuit's ground node to the op amp input. The floating reference cell (20) has a resistive divider (48, 50) across its output. The various nodes along the resistive divider are the nodes selectable as the internal ground node. A variety of voltages of both positive and negative polarity may be derived from the zener diode reference. One or more buffer amplifiers may be connected either to the output of the reference cell or to points on the voltage divider, to provide buffered full Kelvin "force-sense" outputs.

5 Claims, 14 Drawing Figures

VOLTAGE REFERENCE SOURCE WITH TRUE GROUND SENSING AND FORCE-SENSE OUTPUTS REFERRED THERETO

BACKGROUND OF THE INVENTION

1. Field of the Invention

This invention relates to the field of voltage sources—specifically, voltage reference sources. More particularly, the invention relates to the accurate sensing of a ground node to which a voltage reference source is connected. The invention provides a voltage reference source with accurate ground sensing and a variety of pin-programmable output voltages.

2. Discussion of the Prior Art

There are many situations in which an accurate, stable voltage must be applied, as a reference, to a load which sits between two nodes in a circuit or system. A voltage source used for this purpose is referred to as a "voltage reference", "voltage reference source", "reference voltage source" or "reference source". The reference voltage or voltages supplied by such a voltage reference appear at so-called "force" output terminals. Sometimes, a reference source is provided with one or more "sense" terminals, also. A sense terminal may be connected to some node in the circuitry associated with the load, to supply to the reference source feedback information about the effect the reference voltage is producing. The reference source may use the signal applied to the sense terminal to adjust a drive point so as to maintain the force output at the desired level. In some cases, the force and sense terminals may be connected to the same node, but they may also be connected to different nodes in the circuit.

Frequently, one of the nodes to which the voltage reference is connected is a common, or ground, node in the "external" circuit or system. The circuit design for such a system frequently is based on an assumption that every element connected to such a ground node (including any reference voltage sources) rests at the same potential. However, that idealization is not physically achievable. The ground terminals of any two elements connected to the common node often will generally be at slightly different potentials. Because the potential difference is normally quite small (such as a few millivolts or less), though, the assumption that the terminals are at the same potential is usually an acceptable one. Sometimes, however, even a small potential difference is important. For example, where a high gain element in a circuit is sensitive to a voltage at a specific point, a substantial error may be induced when the ground point for the gain element and for the control voltage are at different potentials.

The physical reality of circuit construction must therefore be distinguished from the idealized representation embodied in a schematic circuit diagram. Considering some arbitrary point in the common node as a reference location, every element attached to that node is connected to the reference location through a conductor of finite resistance. Unless there is zero current in the conductor, there is a small, but finite voltage developed on the conductor by the finite current therein. If a reference voltage source is one of the elements connected to the common node, the actual voltage applied to the circuit by the reference source will not be exactly equal to the reference voltage generated by the source but, rather, will vary with the voltage developed between the source's ground terminal and the reference ground point for the system.

In recognition of this problem, voltage references have sometimes been provided with circuitry for forcing their internal ground nodes to the same potential as the "external" system's ground reference point. However, the ability of the reference source to sense any voltage error between the common node of the system and its own internal ground node is also affected by the currents in the connection between the internal ground node of the reference source and the reference point.

Indeed, in some designs, the effect of the ground-error sensing arrangement is to induce in the output of the reference source an error voltage equal to two or more times the "grounding offset voltage"—i.e., the potential difference between the internal ground node of the reference source and the reference point in the load circuit.

It is therefore an object of the present invention to provide a voltage reference source with improved sensing of a ground node.

It is a further object of the invention to provide a voltage reference source capable of providing forced and sensed voltages referenced to that ground node.

Still another object of the invention is to provide a voltage reference source which can provide both positive and negative voltages referred to a ground node.

Yet another object of the invention is to provide such a voltage reference source which is pin-programmable to provide a variety of selectable forced voltages referenced to a ground node.

Yet another object of the invention is to provide a voltage reference source in which the sensitivity to grounding offsets is minimized.

SUMMARY OF THE INVENTION

The present invention achieves at least certain of the foregoing objects by using a voltage reference cell which is floated between two power supplies, and by using an operational amplifier to sense the actual voltage of the ground node in the load circuit to which is it connected, to develop an internal ground reference point for the cell. One input terminal of the operational amplifier connects to the ground node of the external load circuit and the other input terminal of the operational amplifier connects to one of several nodes in the cell, which node thereby becomes the internal ground node of the floating reference cell. The high input impedance of the operational amplifier limits the current in the ground sensing path to a very low value, such as about 10 nA. Consequently, very little voltage error is developed by current in the leads from the load circuit's ground node to the op-amp input.

The floating reference cell comprises a buried zener diode reference, an amplifier to scale the zener voltage up to the required reference voltage range, and a resistive divider on the output of the amplifier. The various connections of the resistive divider serve as the nodes which may become the internal ground node. This arrangement not only permits a variety of voltages to be derived from the single zener diode reference, but also allows those voltages to have both positive and negative polarities. One or more buffer amplifiers may be connected either to the output of the reference cell or to points on the voltage divider, to provide buffered full Kelvin "force-sense" outputs.

The foregoing and other objects, features and advantages of the invention will be more readily understood and apparent from the following detailed description of the invention, which should be read in conjunction with the accompanying drawing, and from the claims which are appended at the end of the detailed description.

DETAILED DESCRIPTION OF AN ILLUSTRATIVE EMBODIMENT

Figure 1:
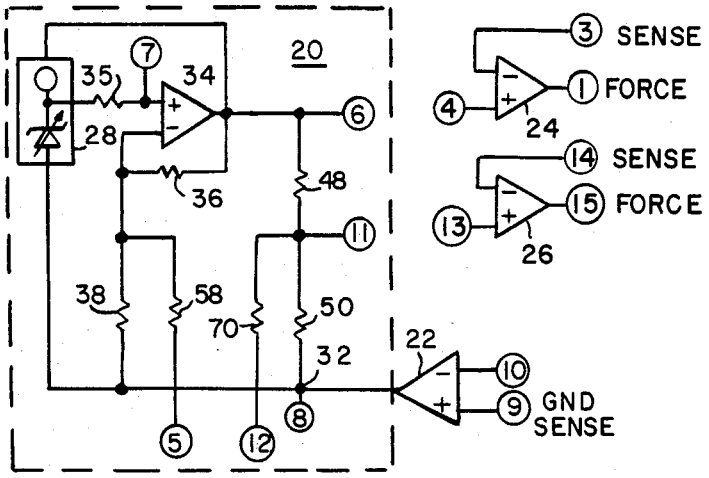
FIG. 1 is a schematic diagram of an exemplary embodiment of the voltage reference source of the present invention.

For purposes of illustration, reference is now made to the diagram of the invention shown in FIG. 1. As seen there, the invention comprises a reference cell 20, an external- (or load-) ground-node-sensing amplifier 22 and one or more buffer amplifiers such as 24 and 26. Reference cell 20 receives power from a power supply which provides a pair of supply voltages Vcc and Vee. However, cell 20 does not have a fixed ground connection; it "floats" between Vcc and Vee. A circuit is shown below for reference cell 20 but it should be understood that the invention is not limited to any particular reference cell circuitry. The inventive concept is adaptable to virtually any reference cell. Further, the use of the buffer amplifiers may be unnecessary in some applications.

In an exemplary form, reference cell 20 comprises a buried zener diode reference 28 and an operational amplifier 34. The buried zener diode reference provides an essentially fixed voltage between node 32 and the non-inverting input of operational amplifier (i.e, "op amp") 34. Node 32 is the internal "floating ground" node of the cell. Current to operate the zener diode reference is derived from the output of op amp 34. Zener diode reference 28 is connected to the non-inverting input of op amp 34 through a series resistor 35. This resistor is included in order to provide a terminal 7 to which a capacitor may be connected, to form a low-pass filter. Such a low-pass filter is sometimes useful to reduce the zener diode's noise contribution to the rest of the circuit.

The gain of op amp 34 is controlled by a conventional arrangement of resistors 36 and 38, with the former connected between the output of the op amp 34 and its inverting input and the latter connected between the inverting input of the op amp 34 and node 32. Op amp 34 provides between its output (which is referred to as the cell's "floating high" output terminal, i.e., terminal 6) and floating ground node 32 an amplified, or scaled, counterpart of the stable reference voltage established by the zener diode reference 28.

The voltage on node 32 is established by amplifier 22. The output of amplifier 22, in turn, is a function of the voltages applied to its inverting and non-inverting inputs on terminals 10 and 9, respectively. The inverting input of operational amplifier 22—i.e. terminal 10—is connected to one of terminals 6, 8 and 11 (i.e., the nodes along the resistive divider 48, 50), depending on the output voltage(s) to be generated.

Amplifier 34 provides scaling of the voltage established by the zener diode reference 28. For example, a 6.5 V zener voltage may amplified to establish a 10 V reference span, or to some other convenient value, depending upon the application requirements. Resistors 48 and 50, which are connected in series between the output of amplifier 34 and node 32, provide a voltage divider. In the exemplary applications discussed below, these two resistors are matched thin film resistors of the same value, but resistors of different values could be used in order to generate desired combinations of output voltages.

Amplifier 22 will supply at its output, node 32, a voltage consistent with the connection established for its inverting input, terminal 10. When terminal 10 is connected to terminal 8 (i.e., node 32), op amp 22 functions as a voltage follower. If, then, terminal 9 is connected to the (external) ground node of the load circuit which the reference source is to drive, the voltage on node 32 will correspond with excellent accuracy to the voltage of the external ground location. When, instead, terminal 10 is connected to one of terminals 6 or 11, amplifier 22 will provide the necessary drive to maintain node 32 at whatever the appropriate voltage. Thus the terminal to which terminal 10 is connected (i.e., terminal 6, 8, or 11, as appropriate) is driven to the load circuit's ground potential. Because of the high input impedance of amplifier 22, there is very little error in sensing that external ground potential. For example, op amp 22 may have an input current of only about 10 nA, which will produce a negligible voltage in the conductor between the amplifier's inverting input and the reference point in the load circuit's ground node. Op amp 22 thus serves the dual purposes of (1) accurately sensing the external ground and (2) setting the voltage on node 32 (i.e., a control node in the reference cell) to a level consistent with selecting one of the available nodes to serve as the internal ground node for the cell.

Turning now to FIGS. 2–19, the utility and versatility of this circuit will become more apparent. Those figures illustrate some of the ways the basic circuit of FIG. 1 may be used to generate various combinations of output voltages from the same floating reference cell.

Figure 2:
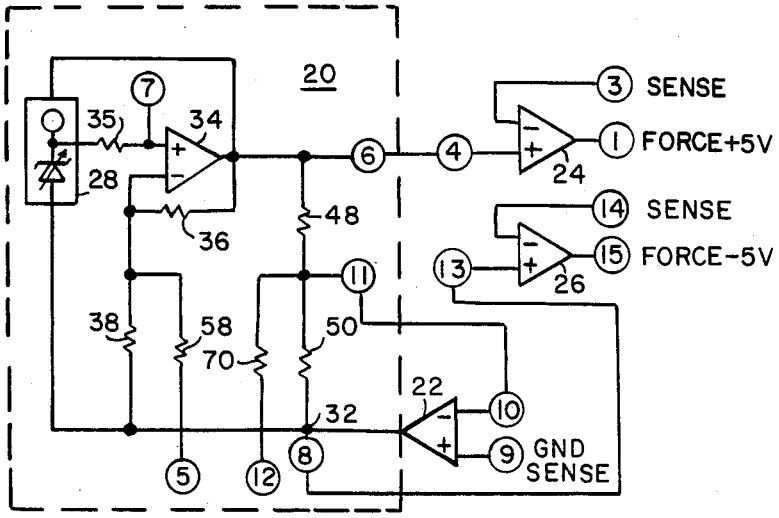
FIG. 2 is a schematic diagram of the source of FIG. 1 configured to provide output voltages of +5 V and −5 V.

Starting with FIG. 2, an arrangement is shown whereby +5 V and −5 V force-sense outputs may be established from the 10 V floating reference generated by cell 20. Terminals 10 and 11 are connected together, so that the midpoint of the voltage divider (resistors 48, 50) is at the system ground potential (i.e., the potential at terminal 9. Terminals 6 and 4 are connected together, providing to the non-inverting input of amplifier 24 the 5 V appearing across resistor 48 (assuming resistors 48 and 50 to be of equal value). Terminals 8 and 13 are connected together, providing to the non-inverting input of amplifier 26 the −5 V relative to terminal 11.

Figure 3:
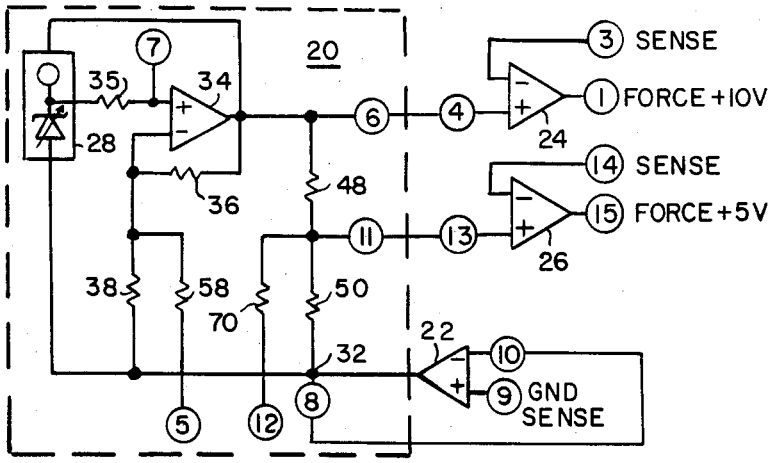
FIG. 3 is a schematic diagram of the source of FIG. 1 configured to provide output voltages of +10 V and +5 V.

In FIG. 3, the same connection is maintained between terminals 6 and 4 but the floating rail at terminal 8 is connected to terminal 10, the inverting input of ground-sense amplifier 22. This establishes terminal 8 at the system ground potential and allows the full 10 V between terminals 6 and 8 to appear at terminal 4 and, thence, the output of buffer 24 (i.e., terminal 1). The midpoint of the voltage divider, terminal 11, is connected to the non-inverting input of buffer 26 at terminal 13, allowing the 5 V which appears across resistor 50 to be supplied at the output of buffer 26 (terminal 15).

Figure 4:
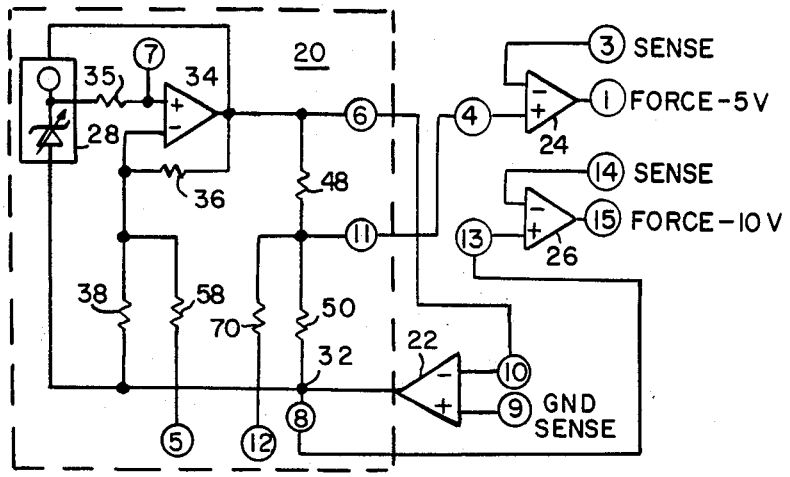
FIG. 4 is a schematic diagram of the source of FIG. 1 configured to provide output voltages of −5 V and −10 V.

In FIG. 4, the polarities of the outputs of FIG. 3 have been reversed, providing −10 V and −5 V by connecting terminals 6 and 10 together to force terminal 6 to system ground potential. Since terminal 11 must be at 5 V negative relative to terminal 6, and it is connected to terminal 4, −5 V appears at the output (terminal 1) of buffer 24. Similarly, since terminal 8 must be 10 V negative with respect to terminal 6, and it is connected to terminal 13, −10 V appears at the output of buffer 26 (i.e. terminal 15).

Figure 5:
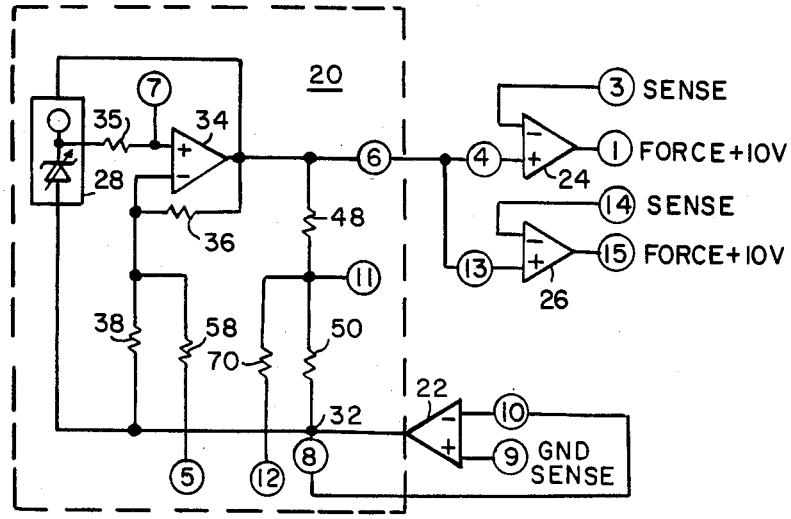
FIG. 5 is a schematic diagram of the source of FIG. 1 configured to provide output voltages of +10 V and +10 V.
Figure 6:
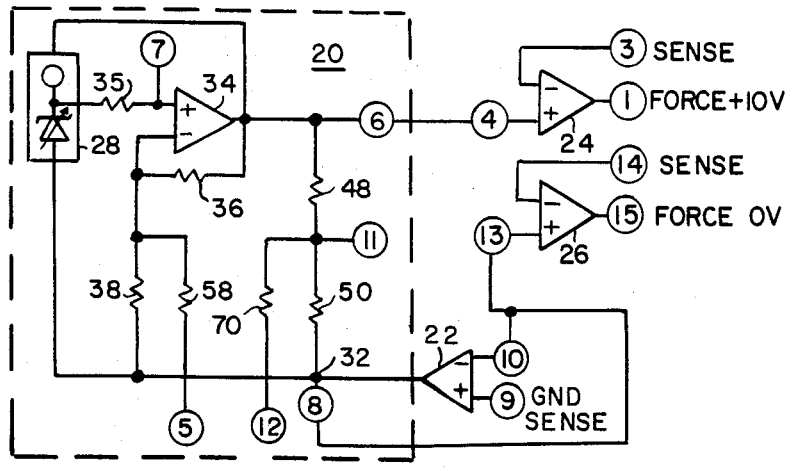
FIG. 6 is a schematic diagram of the source of FIG. 1 configured to provide output voltages of +10 V and 0 V.

In FIG. 5, the arrangement has been varied by connecting terminal 13 to terminal 6 so that both buffers 24 and 26 provide the same +10 V output. The third variant which is possible on this theme is illustrated in FIG. 6 wherein terminal 13 is connected to terminal 8, which is at the system ground potential, producing a 0 V output from buffer 26.

Figure 7:
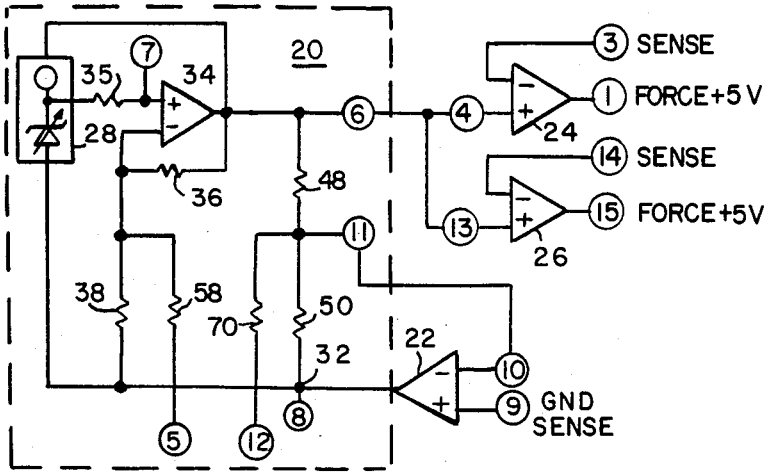
FIG. 7 is a schematic diagram of the source of FIG. 1 configured to provide output voltages of +5 V and +5 V.

FIG. 7 shows a circuit analogous to that of FIG. 5 in that buffers 24 and 26 are connected and parallel to provide the same output voltage. In this case, however, the output is +5 V, which is obtained by connecting terminals 10 and 11 together and connecting terminals 4 and 13 to terminal 6.

Figure 8:
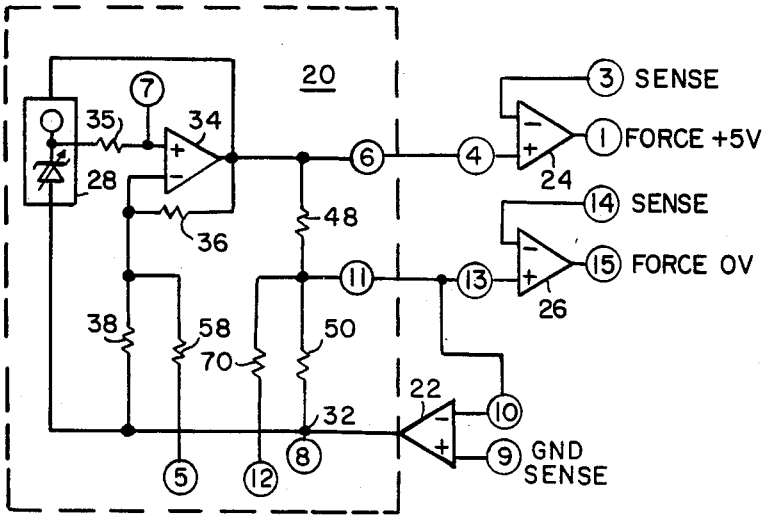
FIG. 8 is a schematic diagram of the source of FIG. 1 configured to provide output voltages of +5 V and 0 V.

By moving the connection from terminal 13 onto terminal 11, the output of buffer 26 is changed to 0 V, as shown in FIG. 8.

Figure 9:
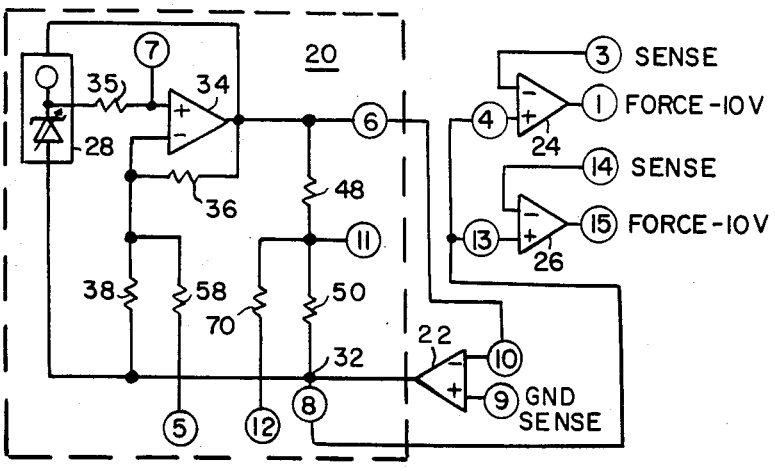
FIG. 9 is a schematic diagram of the source of FIG. 1 configured to provide output voltages of −10 V and −10 V.

In the arrangement of FIG. 9, the circuit of FIG. 4 has been modified by connecting terminal 4 to terminal 8 instead of to terminal 11, so that buffers 24 and 26 provide −10 V outputs.

Figure 10:
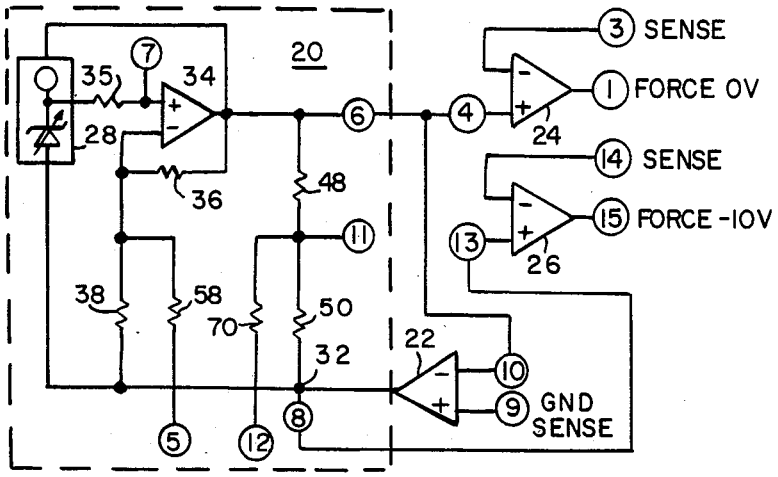
FIG. 10 is a schematic diagram of the source of FIG. 1 configured to provide output voltages of 0 V and −10 V.

By retaining the connections of FIG. 9 except connecting terminal 4 to terminal 6 instead of to terminal 8, buffer 24 is caused to provide a 0 V output while buffer 26 retains its −10 V output. This is shown in FIG. 10.

Figure 11:
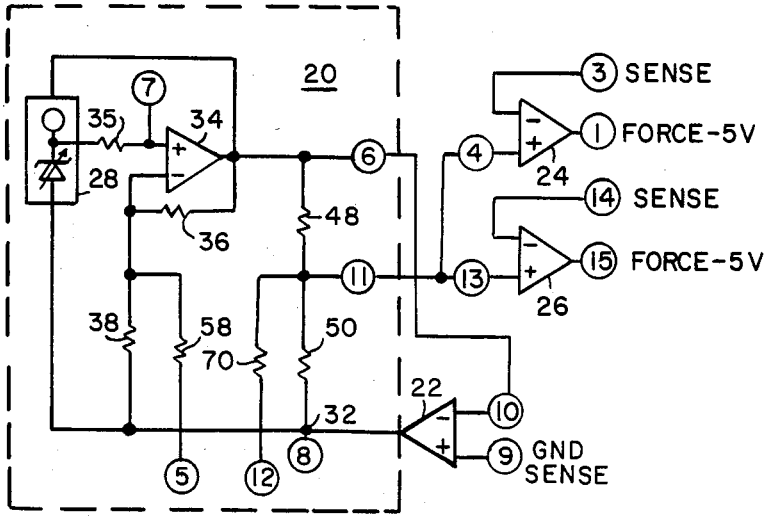
FIG. 11 is a schematic diagram of the source of FIG. 1 configured to provide output voltages of −5 V and −5 V.

In FIG. 11, parallel −5 V outputs are provided from buffers 24 and 26 by connecting terminals 6 and 10 together and connecting terminals 4 and 13 to terminal 11.

Figure 12:
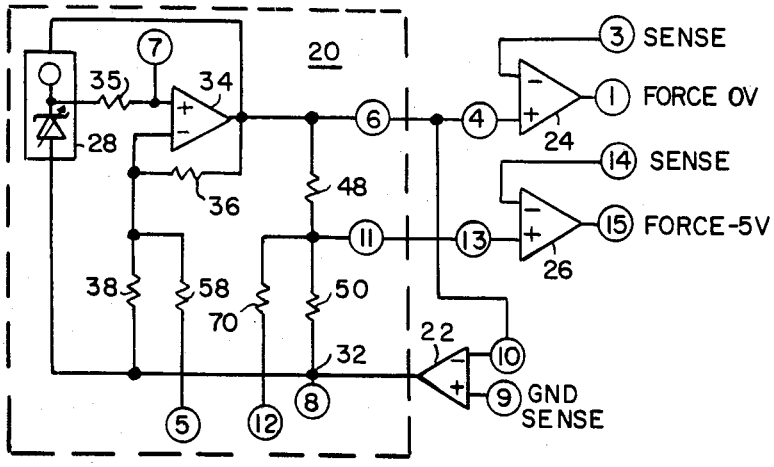
FIG. 12 is a schematic diagram of the source of FIG. 1 configured to provide output voltages of 0 V and −5 V.
Figure 13:
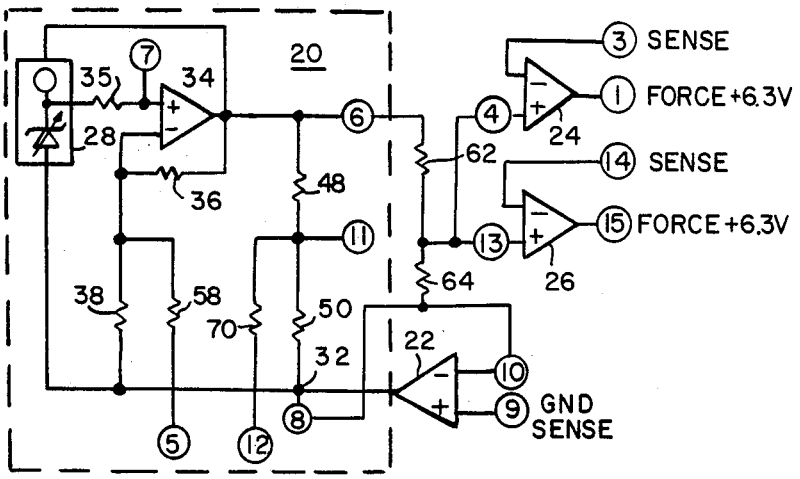
FIG. 13 is a schematic diagram of the source of FIG. 5, modified by the addition of a pair of resistors to change the voltage divider ratio in order to provide output voltages of, for example, +6.3 V and +6.3 V.

Connecting terminal 4 to terminal 6 instead of terminal 11 yields the arrangement of FIG. 12, wherein buffer 24 provides a 0 V output and buffer 26 continues to provide −5 V.

Connecting terminals 5 and 8 places resistors 38 and 58 in parallel and allows the gain of the internal reference cell to be modified so that it no longer provides a 10 V output span. For example, if this connection is made within the circuit of FIG. 5, proper choice of a value for resistor 58 will change the output voltages from 10 V to 10.24 V. This is a convenient number to use as it provides 10 mV/step resolution when converted to a 10-bit digital counterpart. Resistor 58 may be provided in the same monolithic package as the remainder of the circuit elements, in which case it can be bonded into the circuit at the time of packaging by connecting terminals 5 and 8 within the package. Alternatively, external terminals can be provided for this purpose. By packaging resistor 58 with the remainder of the components, not only may its resistance be closely controlled, but also its temperature coefficient will track those of the other circuit components.

Of course, the same external resistor 58 may be used to provide a −10.24 V output, by making a similar modification to the circuit of FIG. 9. Or, resistor 58 may be added to the arrangement of FIG. 6 to provide 10.24 V and 0 V outputs; or to the arrangement of FIG. 10, to provide 0 V and −10.24 V outputs.

Resistors may also be added externally across terminals 6, 11 and 8 to vary the voltage divider relationship. This permits the generation at the outputs of any desired voltage within the 10 V span, appearing across terminals 6 and 8. For example, resistors 62 and 64 may be added, as in FIG. 13, to provide 6.3 V between their junction (which is connected to terminals 4 and 13) and terminal 8. Similarly, −6.3 V may be generated.

Figure 14:
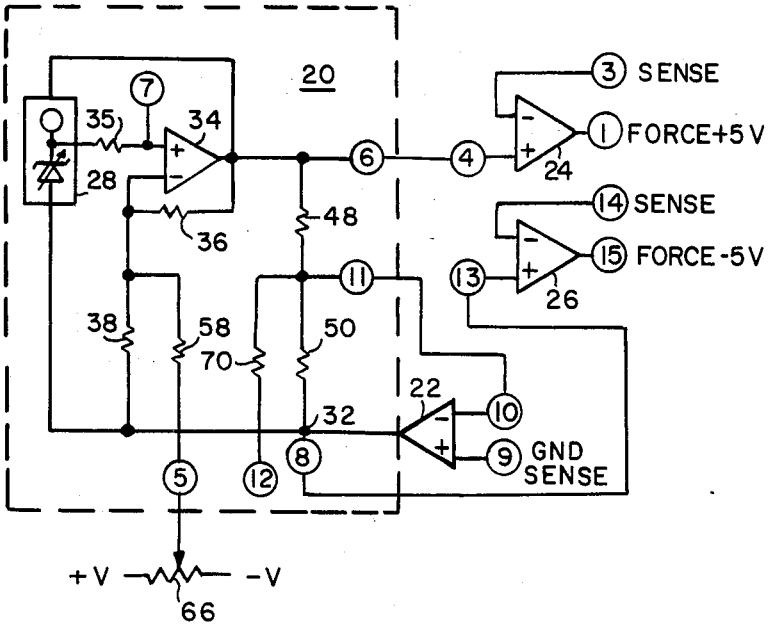
FIG. 14 is a schematic diagram of the source of FIG. 2 with a gain-adjustment potentiometer added.

Another variation shown in the drawing is a modification of FIG. 2 by the provision of an external potentiometer 66 connected between plus and minus voltages (e.g., at terminals 6 and 8), and the wiper of potentiometer 66 connected to resistor 58 at terminal 5. This arrangement is shown in FIG. 14.

Finally, a resistor 70 (see FIG. 1) may be connected in parallel with either resistor 48 or 50, as needed, to provide fine adjustment of the voltage divider ratio. This connection may be accomplished by connecting terminal 12 to either terminal 6 or terminal 8, as appropriate. The divider ratio may also be varied with a potentiometer, for precise adjustment. This is preferably accomplished by connecting the ends of the potentiometer between terminals 6 and 8, with the wiper connected to terminal 12; that way, resistor 70 limits the trim range provided by the potentiometer, allowing finer adjustment of the divider ratio.

Since the op amp 22 establishes a one-to-one correspondence between the load circuit ground potential and the internal potential on node 32, any error is reflected only one-for-one in the output of the voltage reference, and is not magnified.

Having thus described the theory of the invention, a specific illustrative embodiment, and numerous circuit applications, it will be readily apparent that various alterations, substitutions and modifications will occur and be obvious to those skilled in this technology. All of such obvious alterations, substitutions and modifications are intended to be suggested herein and encom-passed within the protection sought hereby. Accordingly, it is intended that this disclosure be read as being exemplary only, and not as limiting. Thus the invention is to be limited only by the claims which follow hereafter and by equivalents thereto.

What is claimed is:

1. A reference voltage source for driving a load circuit in which voltages are referred to a ground node, such source comprising:

a. a floating reference cell for establishing a stable reference voltage between first and second nodes, the first node being referred to as a floating high output node and the second node being referred to as a floating ground node;

b. means for sensing the voltage of the load circuit ground node; and c. means for forcing one of the first and second nodes to substantially the same voltage as the load circuit ground node.

2. The reference voltage source of claim 1 wherein the means for forcing comprises an operational amplifier having first and second inputs and an output, the output of the operational amplifier being connected to the floating ground node, the first input of the operational amplifier being connected to the load circuit ground node and the second input of the operational amplifier being connected to said one of the first and second nodes.

3. A reference voltage source for driving a load circuit, the load circuit having a ground node, such source comprising:

a. a floating reference cell for establishing a stable reference voltage between first and second nodes, the first node being referred to as a floating high output node and the second node being referred to as a floating ground terminal;

b. a voltage divider network connected between the first and second nodes and providing at least one voltage divider node therebetween;

c. means for sensing the voltage of the load circuit ground node; and d. means for forcing one of the first and second nodes and voltage divider nodes to substantially the same voltage as the load circuit ground node.

4. A reference voltage source for driving a load circuit, the load circuit having a ground node, such source comprising:

a. a floating reference cell for establishing a stable reference voltage between first and second nodes, the first node being referred to as a floating high output node and the second node being referred to as a floating ground terminal, said floating reference cell having (1) a buried zener diode reference, and (2) an amplifier having an input connected to the buried zener diode reference and an output connected to the first node;

b. a voltage divider network comprising a plurality of resistors connected in series between the first and second nodes and providing at least one voltage divider node therebetween; and c. an operational amplifier having first and second inputs and an output, the output of the operational amplifier being connected to the floating ground node, the first input of the operational amplifier being connected to the load circuit ground node and the second input of the operational amplifier being connected to one of the first and second nodes and the voltage divider nodes, thereby to force the voltage at said node to substantially equal the voltage at the load circuit ground node.

5. The source of claim 4 further including at least one buffer amplifier having first and second inputs and an output, the first input of each such buffer amplifier being connected to one of the first, second and voltage divider nodes, the second input of each such buffer being available for connection as a sense terminal for sensing a voltage in the load circuit and the output of each such buffer providing a force output for forcing a node in the load circuit to the voltage present to the first input of the buffer amplifier.

* * * * *